US006428676B1

(12) United States Patent
Onuoha

(10) Patent No.: US 6,428,676 B1
(45) Date of Patent: Aug. 6, 2002

(54) PROCESS FOR PRODUCING LOW ALPHA LEAD METHANE SULFONATE

(75) Inventor: Anthony C. Onuoha, New Haven, CT (US)

(73) Assignee: Enthone Inc., West Haven, CT (US)

( * ) Notice: Subject to any disclaimer, the term of this patent is extended or adjusted under 35 U.S.C. 154(b) by 0 days.

(21) Appl. No.: 09/708,168

(22) Filed: Nov. 8, 2000

(51) Int. Cl.[7] ..... C25B 1/00

(52) U.S. Cl. ..... 205/478; 205/494; 204/252; 204/279

(58) Field of Search ..... 205/494, 478; 204/279, 252

(56) References Cited

U.S. PATENT DOCUMENTS

| | | | | |
|---|---|---|---|---|
| 3,300,397 A | | 1/1967 | Baltakmens et al. | |
| 3,413,203 A | | 11/1968 | MacLean | |
| 3,649,482 A | | 3/1972 | Yang et al. | |
| 3,649,483 A | | 3/1972 | Settineri et al. | |
| 3,795,595 A | | 3/1974 | Wilson | |
| 4,253,932 A | * | 3/1981 | Mose | 204/279 |
| 4,297,194 A | | 10/1981 | Dotson et al. | |
| 4,464,238 A | | 8/1984 | Caldwell et al. | |
| 4,650,553 A | | 3/1987 | Felgendreger et al. | |
| 4,794,172 A | | 12/1988 | Kreh | |
| 4,877,498 A | | 10/1989 | Fukuda et al. | |
| 4,894,128 A | | 1/1990 | Beaver | |
| 4,915,803 A | | 4/1990 | Morris | |
| 4,940,518 A | * | 7/1990 | Morris | 204/279 |
| 5,082,538 A | | 1/1992 | DeRespiris et al. | |
| 5,520,794 A | | 5/1996 | Gernon | |
| 5,562,814 A | | 10/1996 | Kirby | |
| 5,618,404 A | | 4/1997 | Okuhama et al. | |
| 5,679,237 A | | 10/1997 | Chamard et al. | |

OTHER PUBLICATIONS

The Anodic Dissolution of Lead in Sulfonic Acid, W. L. Hsueh and C. C. Wan, Department of Chemical Engineering, National Tsing Hua University, Journal of The Chin. I. E., vol. 20, No. 1, 1989, pp. 41–44.

* cited by examiner

*Primary Examiner*—Arun S. Phasge
(74) *Attorney, Agent, or Firm*—Senniger, Powers, Leavitt & Roedel

(57) ABSTRACT

This invention provides a process for the electrolytic production of metal containing solutions and in particular a high concentration low impurity low alpha lead methane sulfonate solution using a specially designed electrolytic membrane cell. The process electrolytically dissolves low alpha lead in the anode compartment of the electrolytic cell using an anion exchange membrane that separates the anode compartment from the cathode compartment. The specially designed electrolytic cell can also be used to electrolytically dissolve other metals such as tin, copper, etc. in a suitable electrolyte and membrane. The cell utilizes a two-part membrane holder having a female member and a male member, one of which is attached to the cell walls and base with a water tight seal. The membrane holder effectively minimizes contamination between the anode and cathode compartments and allows the use of inexpensive materials such as stainless steel for the cathode.

13 Claims, 6 Drawing Sheets

(FRONT VIEW)

(BACK VIEW)

PROCESS FOR PRODUCING LOW ALPHA LEAD METHANE SULFONATE

BACKGROUND OF THE INVENTION

1. Field of the Invention

This invention relates to the electrolytic production of metal containing solutions and, more particularly, to the electrolytic production of a low alpha lead methane sulfonate solution with low free acid and impurities using a specially designed membrane cell.

2. Description of Related Art

Electrochemical dissolution of lead in methane sulfonic acid results in the formation of lead methane sulfonate. This product is currently utilized in the electronics fabrication industry such as in the flip chip packaging technology which uses controlled collapse chip connection (C4 process) to connect electronic components. The electrochemical process equations for making lead methane sulfonate are shown in equations 1–2 below:

Anode Reactions $$Pb_{solid} \rightarrow Pb^{2+}{}_{aqueous} + 2e^- \qquad \text{Eqn 1}$$

$$Pb^{2+}\ \text{aqueous} + 2CH_3SO_3^-\ \text{aqueous} \longrightarrow \underset{\text{Lead methane sulfonate}}{Pb(SO_3CH_3)_2} \qquad \text{Eqn 2}$$

Cathode Reaction $$2CH_3SO_3H + 2e^- \longrightarrow 2CH_3SO_3^-{}_{aqueous} + H_2\uparrow \qquad \text{Eqn 3}$$

$$\downarrow$$

Migrates to anode

At the anode lead metal dissolves by the loss of two electrons to form lead (II) ions in solution. The lead ions subsequently react with methane sulfonate ions to form the desired lead II methane sulfonate in solution. The formation of lead methane sulfonate in the anode compartment is made possible if a membrane layer, preferably an anion exchange type, partitions the anode compartment from the cathode compartment. In an electrolytic cell with an anion exchange membrane partition, lead II ions that forms at the anode are strongly repelled by the membrane, and hence do not migrate to the cathode electrode surface. Methane sulfonic acid electrolyte is preferentially reduced to its sulfonate ion with the evolution of hydrogen gas at the cathode surface, and the catholyte methane sulfonate ions migrate through the membrane to the anolyte where they react with the lead (II) ions to form the desired lead methane sulfonate solution. The anion exchange membrane chemistry allows only anions to pass through it whereas cationic species are normally repelled by it.

Hsueh W. L. and Wan C. C. (1989 Journal of the Chin. I. Ch. E., Vol. 20, No. 1) demonstrated the electrolytic dissolution of lead in a solution of methane sulfonic acid in a laboratory cell using lead panels (99.5% purity) as an anode and graphite panels as cathode, with the cathode compartment separated from the anode compartment by an anion exchange membrane. The anode and cathode compartments of this cell each contained 500 ml of electrolyte, with the anolyte and catholyte initially containing 1.3% and 50% of methane sulfonic acid respectively.

Electrolytic cells that incorporate ion exchange membranes or porous diaphragms for the dissolution of such metals like lead, tin, etc., in suitable electrolytes have been described. U.S. Pat. No. 5,618,404 issued Apr. 8, 1997 discloses the production of lead and tin sulfonate by the use of an acrylic-based electrolytic cell having an anode chamber of 250 ml capacity, two 100 ml product chambers, and two 324-ml cathode chambers. The anode electrode material was a lead or tin rod (99.9% purity) placed in the center of the anode chamber. Two pieces of titanium sheets, 0.9 $dm^2$ each, served as the cathode electrodes. The lead dissolution process and cell design was such that dissolved metals with low alpha counts were only produced by a simultaneous combination of anion and cation exchange membranes in the cell. Metal sulfonates with elevated alpha counts resulted when only anion exchange membranes were used. U.S. Pat. Nos. 3,795,595 and 3,300,397 using electrolytic cells with an ion exchange membrane or a porous woven material, disclose the production of metallic salts in electrolytes other than a methane sulfonic acid medium and with electrolytic cells having small capacity (~2.5 L), or utilizing environmentally unfriendly mercury cathodes.

Bearing in mind the problems and deficiencies of the prior art, it is therefore an object of the present invention to provide an electrolytic process for making metal solutions in an electrolytic membrane cell.

It is another object of the present invention to provide a process for making lead methane sulfonate and in particular low alpha lead methane sulfonate in an electrolytic membrane cell.

A further object of the invention is to provide a membrane cell for electrolytic production of metal containing solutions.

It is yet another object of the present invention to provide a membrane cell for electrolytic production of lead methane sulfonate and low alpha lead methane sulfonate solutions.

Another object of the present invention is to provide metal containing solutions and in particular high concentration low impurity lead methane sulfonate and low alpha lead methane sulfonate solutions.

Still other objects and advantages of the invention will in part be obvious and will in part be apparent from the specification.

SUMMARY OF THE INVENTION

The above and other objects, which will be apparent to those skilled in the art, are provided in the present invention which, in one aspect, is directed to a method for electrolytically making a metal containing solution and, in particular, a lead methane sulfonate solution, e.g., low alpha lead methane sulfonate solution, comprising the steps of:

providing an electrolytic cell comprising a tank having opposed walls and a bottom, a consumable lead source as an anode, a spaced apart cathode, a membrane, preferably anionic, separating the anode and the cathode forming an anode chamber and a cathode chamber, the membrane having a top edge, bottom edge and opposed side edges and being held along the bottom edge and opposed side edges between a membrane holder comprising a female member comprising opposed vertical members and a connecting lower member the members having an outer peripheral edge and an inner peripheral edge forming an open space between the inner peripheral edges, and the vertical members and connecting lower member having openings for securing a bolt or other fastener, and preferably the openings are only partly therethrough, and a mating male member comprising corresponding opposed vertical members and a connecting lower member, the members having an outer peripheral edge and an inner peripheral edge forming an open space between the inner peripheral edges, and the vertical members and connecting lower members having openings therein, preferably through openings, corresponding to the openings in the female member, with the female member and male member being secured together by fasteners, e.g., bolts, extending through the openings in the male member and into the female member openings wherein either the outer peripheral edge of the male member or female member, preferably the male member, forms a watertight seal with the opposed side walls and tank bottom, e.g., is integrally secured to the opposed side walls and tank bottom;

supplying methane sulfonic acid or other electrolyte acid to the anode chamber and the cathode chamber;

supplying a current between the anode and the cathode to electrolytically dissolve the lead anode forming lead ions in the anode chamber and ionizing the methane sulfonic acid in the cathode chamber to form methane sulfonic acid ions;

continuing the current preferably with a controlled voltage or a controlled current until the desired concentration of lead methane sufonate solution is obtained; and removing the lead methane sulfonate solution from the tank.

In another aspect of the invention an electrolytic cell is provided for making metal containing solutions and in particular, a lead methane sulfonate solution, e.g., a low-alpha lead methane sulfonate solution comprising:

a tank having opposed walls and a bottom;

a consumable lead source as an anode;

a spaced apart cathode;

an energy source for applying an electric current between the anode and the cathode; and a membrane, preferably anionic, separating the anode and the cathode forming an anode chamber and a cathode chamber, the membrane having a top edge, bottom edge and opposed side edges and being held along the bottom edge and opposed side edges between a membrane holder comprising a female member comprising opposed vertical members and a connecting lower member, the members having an outer peripheral edge and an inner peripheral edge forming an open space between the inner peripheral edges, and the vertical members and connecting lower members having openings for securing a bolt or other fasteners, and preferably the openings are only partly therethrough, and a mating male member comprising corresponding opposed vertical members and a connecting lower member, the members having an outer peripheral edge and an inner peripheral edge forming an open space between the inner peripheral edges, and the vertical members and connecting lower members having openings therein, preferably through openings corresponding to the openings in the female member, with the female member and the male member being secured together by fasteners, e.g., bolts, extending through the openings in the male member and into the female member openings wherein either the outer peripheral edge of the male member or female member, preferably the male member, forms a watertight seal with the opposed side walls and tank bottom, e.g., is integrally secured to the opposed walls and tank bottom.

In another aspect of the invention a plurality of female members and/or male members are fixedly secured to the opposed walls and tank bottom at spaced apart intervals so that the size of the anode chamber or cathode chamber can be easily changed depending on which member is joined with a corresponding mating member to form the membrane holder.

In a further aspect of the invention a membrane holder for holding a membrane in an electrolytic cell having side walls and a bottom is provided comprising:

a female member comprising opposed vertical members and a connecting lower member, the members having openings for securing a bolt or other fastener, and preferably the openings are only partly therethrough;

a corresponding male member comprising corresponding opposed vertical members and a connecting lower member, the members sized to mate and form a watertight seal with the female member, with either the female member or male member being sized to form a watertight seal with the side walls and bottom of the cell, e.g., U-shaped for a rectangular cell, and having openings therein in the opposed vertical members and connecting lower member corresponding to the openings in the opposed vertical members and connecting lower member of the female member; and wherein, in use, a membrane is secured between the female member and male member preferably with a gasket material and fasteners, e.g., bolts, extending in the openings in the male member and the female member openings to secure the membrane in the membrane holder.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
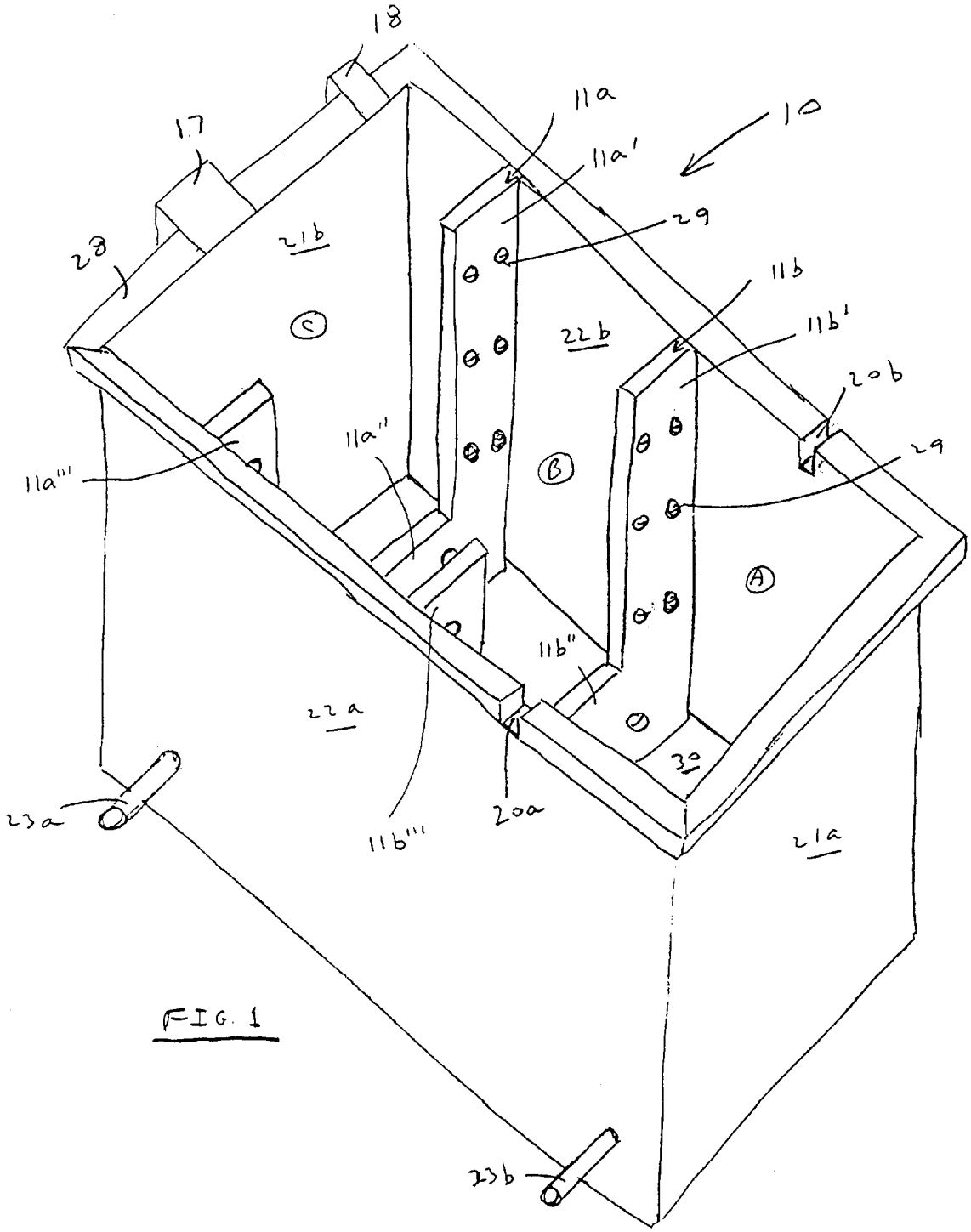
FIG. 1 is a perspective view of an electrolytic cell of the invention.

In describing the preferred embodiment of the present invention, reference will be made herein to FIGS. 1–5 of the drawings in which like numerals refer to like features of the invention. Features of the invention are not necessarily shown to scale in the drawings.

The present invention provides an improved process for the electrolytic production of metal salts in solution and in particular a low alpha lead (LAL) methane sulfonate solution. The invention employs a specially designed electrolytic cell and an electrolytic process which is capable of dissolving a high volume concentration of metals in the anolyte, typically up to 350 grams per liter of metal or more. The method does not require an evaporation step to increase the concentration of the LAL methane sulfonate solution or the use of a cation exchange membrane. The electrolytic cell is cost effective and allows for easy installation and removal of any type of membrane used in the electrolytic cell. The membrane when used with the apparatus and method of the invention effectively prevents the migration of trace metal contaminants from the catholyte to the anolyte, especially when an anion exchange membrane and an inexpensive stainless steel cathode are utilized in the cell. The migration of lead ions from the anolyte to the catholyte is also effectively inhibited. This cell can be utilized to produce solutions of metal salts with high alpha or low alpha contents depending on the raw material specification of the dissolving metal and typical metals which can be used include tin, copper and lead. The following description will be specifically directed to lead for convenience but it will be appreciated by those skilled in the art that any suitable metal and electrolyte may be used.

The apparatus of the invention may be used in an electrolytic process for the production of lead and low alpha lead methane sulfonate solutions, or other metallic solutions, that uses an electrolytic cell with a soluble metal anode. A preferred method and apparatus uses a platinized-niobium mesh anode-cage filled with low alpha lead slugs or other dissolvable metals, stainless steel or other metals such as platinized-metal as the cathode and an anion exchange membrane layer separating the anode from the cathode.

A specially designed membrane holding structure is used which comprises, for a rectangular cell, a U-shaped female member and a corresponding U-shaped male member that in combination with fasteners such as bolts, gaskets and washers enable one, two or more membrane layers of a membrane material to be held therebetween with a watertight seal to separate the electrolytic cell into an anode compartment and a cathode compartment. Either the female member or male member is fixed to the walls and base of the cell to provide a water tight seal between the member and the cell. If multiple membrane layers are used, the spaces between the membranes are preferably filled with the cell electrolyte.

The process is an electrolytic process in which the metal dissolution medium is an electrolyte, e.g. 10–60 percent methane sulfonic acid and preferably 15–35% and most preferably about 18–22%, e.g., 20% methane sulfonic acid. Other electrolytes such as sulfuric acid may be used in which the metal is dissolved in the anode compartment and the metal ions are prevented from migrating to the cathode compartment by the membrane system. It is preferred to use an initial electrolyte concentration in each compartment which is within about ±5% and which is preferably substantially the same. It is also preferred to start with and maintain the height of liquid in each compartment at about the same level. Further, during electrolysis, additional electrolyte (typically the same concentration as the starting electrolyte or within ±5%) is preferably added to the cathode compartment to maintain the desired electrolyte concentration in that compartment and it is preferred that water (e.g., deionized) be added to the anode compartment to maintain the electrolyte level substantially even in both compartments.

An important part of the invention resides in an electrolytic process in which the anion exchange membrane separator utilized prevents or minimizes migration of trace metals from the catholyte to the anolyte especially when stainless steel cathodes are used. The electrolytic process also allows for the electrolytic production of lead methane sulfonate solutions, or other metallic salt solutions, with less than 10 percent free acid content. With this electrolytic process, low alpha lead methane sulfonate solutions are produced by electrolytically dissolving low alpha lead slugs in the anode compartment of the cell and the formation of a lead methane sulfonate acid solution at lead concentrations greater than 100–300 grams per liter without any evaporation step.

Referring now to the figures, FIG. 1 shows a perspective view of an electrolytic cell of the invention generally as numeral 10. The cell is rectangular in shape and has opposed side walls 22*a* and 22*b* and 21*a* and 21*b* and a base or bottom 30. A lip or flange 28 extends around the upper periphery of the cell. Also at the upper periphery of the cell are flanges 17 and 18 used to mount devices thereon such as a heater on flange 17 and a liquid height sensor on flange 18. Other flanges may be situated around the edge of the cell for various purposes.

Lip 28 has cutouts 20*a* and 20*b* on sidewalls 22*a* and 22*b*, respectively, for supporting a cathode which is normally of a T-shape with the ends of the T resting in the cutout openings 20*a* and 20*b*.

Integral thereto or fixedly attached thereto in a watertight relationship with the walls of the cell are male membrane holders 11*a* and 11*b*. Each male membrane holder is of a U-shape conforming to the size and shape of the side walls and base of the cell. Holder 11*a* has opposed vertical leg members 11*a*' and 11*a*''' and a connecting lower member 11*a*''. A similar configuration is shown for male membrane holder 11*b* which has opposed vertical leg members 11*b*' and 11*b*''' and a connecting lower member 11*b*''. A plurality of through openings 29 are provided in the male members at spaced apart intervals. As will more fully be described hereinbelow, the female member of the membrane holder will have bolts secured thereto with, in sequence, a gasket, a membrane and another gasket all having corresponding openings and fitted over the bolts, which assembled female member will then be positioned in the cell and the bolts secured therein passed through the corresponding male membrane holder openings 29. The female member will then be secured to the male member by nuts or other fastening means as also described hereinbelow. Such a configuration provides a watertight seal between the membrane and the membrane holder and eliminates any significant migration of impurities from one compartment of the cell to another compartment.

As can be seen from FIG. 1, if a cathode is positioned in cutouts 20*a* and 20*b* and a female membrane member secured to male membrane holder 11*b*, the cathode compartment will comprise the cell volume shown as A. The anode compartment would then comprise the cell volumes shown as B+C. If the female membrane was secured to male membrane member holder 11*a*, the cathode compartment would comprise A+B and the anode compartment would comprise C.

As will be appreciated by those skilled in the art, the size of the cell as well as the number of male membrane holders spaced along the cell wall will determine the size of the anode compartment and cathode compartment. It will also be appreciated by those skilled in the art that the membrane holders 11*a* and 11*b* shown as male membrane holders may be instead the female membrane holders or any combination of male and female holders with it being preferred that it be the male membrane holder members which are integral to or secured to the cell walls and base. Outlet ports are shown as 23*a* and 23*b*.

Figure 2:
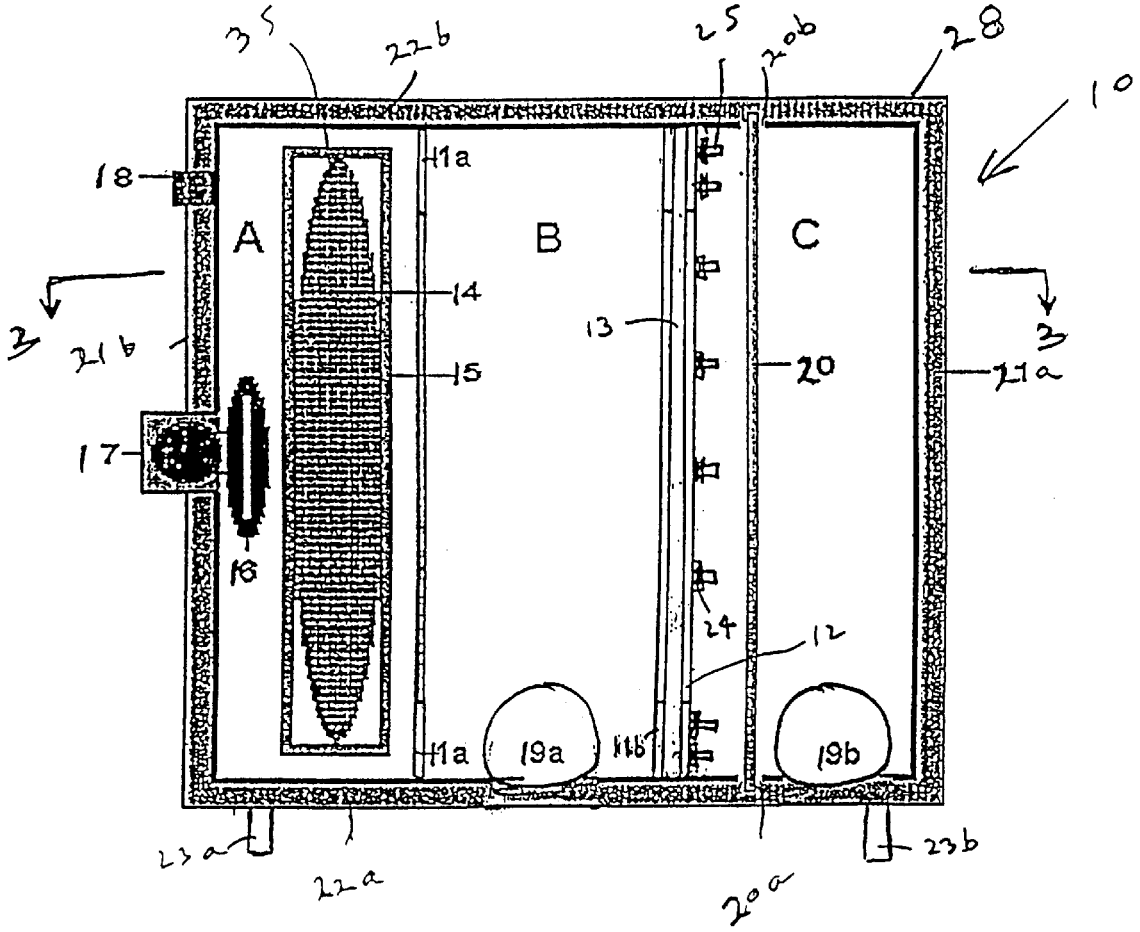
FIG. 2 is a schematic plan view of an electrolytic cell of the invention.

A top view of an electrolytic cell of the invention used to dissolve lead slugs (or other metals) in a given electrolytic medium is shown in FIG. 2. The cell shown generally as 10 is rectangular and has opposed walls 21*a* and 21*b* and 22*a* and 22*b*. The cell is preferably fabricated from a plastic such as a PVC but can also be made from other electrolytic resistance non-conducting materials. Other shaped cells can be used such as cylindrical and the like.

The electrolytic cell herein described comprises an anode compartment and a cathode compartment, separated by a single membrane or layers of membranes and the membrane (s) are preferably anion exchange membrane(s). A special feature of this cell is a two-piece U-shaped membrane holder shown as male member 11*b* secured to the walls and base of the cell and female member 12. The female member is moveable and allows for a choice in the working volume of the anode or cathode compartments as desired. The use of the two-piece membrane holder also allows for the use of multiple side-by-side membranes or a single membrane to separate the anode compartment from the cathode compartment. When multiple membranes are used, this feature allows the space between the individual membrane layers to be filled with the conducting electrolyte without leaking or mixing of materials between the anode compartment, cathode compartment or membrane layers.

The anode of the rectangular shaped electrolytic cell 10 is a cage-like platinized-niobium mesh structure 14, filled with the desired metal 35 to be dissolved. The Pt-Nb anode mesh structure 14 is supported by a rectangular-shaped PVC basket 15 which sits in the cell or be supported by the cell walls. The cathode 20 is a T-shaped sheet of stainless steel, with through holes scattered on its surface for effective mass transport of the electrolyte within the cathode compartment C. The stainless steel cathode is placed within the cathode compartment such that its T-ends make contact with the PVC walls of the electrolytic cell at side wall cutout points 20*a* and 20*b*. Other metallic electrodes as known in the art can also serve as the cathode.

The cathode compartment of the electrolytic cell is shown as the region C of the cell 10 which region is partitioned from the anode compartment, shown as A+B, by a membrane 13. The working volume of the anode or cathode compartments, i.e., A and B+C or A+B and C , respectively, depends on the position of the membrane 13 in the electrolytic cell. When the membrane 13 is fastened at the U-shaped male member 11*a* using female member 12, region A of the electrolytic cell (FIG. 1) becomes the anode compartment, while regions B+C form the cathode compartment. When the membrane 13 is fastened in place at the U-shaped member 11*b* using female member 12 as shown in FIG. 2, sections A+B define the anode compartment, while only region C becomes the cathode compartment. Thus the U-shaped male membrane members of the electrolytic cell 11*a* and 11*b* in combination with a moveable U-shaped female member 12 allow for selectivity in the operational volume of either the anode or cathode compartments of the cell respectively.

The membrane holder structures 11*a* and 11*b* fixed at the walls and base of the wall are preferably the male parts of the membrane holder, with the movable holder member being the female member 12. The preferred female member 12 is shown in more detail in FIG. 3. The male member (or female member) of the membrane holder is preferably integral (fixedly secured) to the side walls and bottom of the tank forming a watertight seal between the tank and the membrane holder member. The membrane holder may also be moveably attached to the cell walls and base but this is not preferred.

Referring again to FIG. 2, motorized impellers 19*a* and 19*b* mounted in the anode and cathode compartments of the cell ensure efficient mass transport of materials in each compartment. A PVC platform 17 is welded at the top of the electrolytic cell 10 on lip 28 along wall 21*b* and the platform 17 serves as a base mount for an immersion heater 16. A fluid level sensor may similarly be mounted on platform 18. Both heater 16 and fluid level sensor 18 are connected to a controller unit (not shown).

Figure 3:
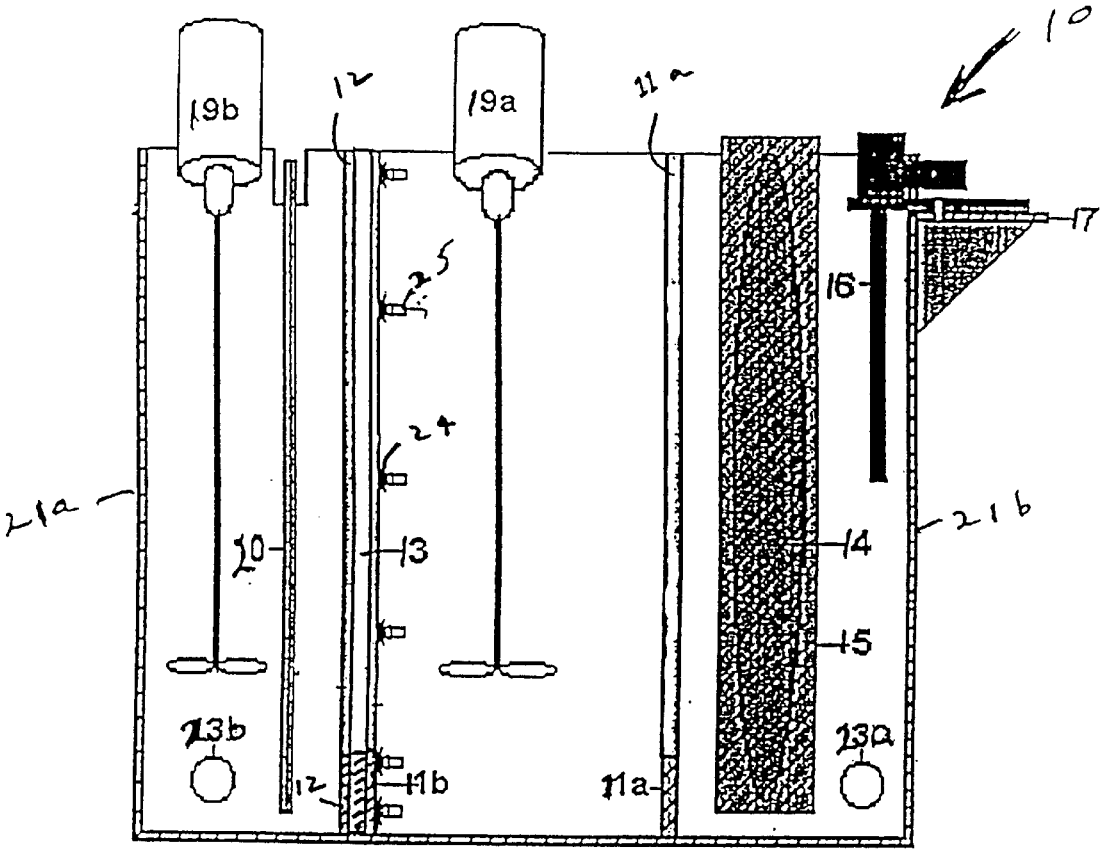
FIG. 3 is a cross-sectional view of the electrolytic cell of FIG. 1 taken along lines 3—3.

A cross-sectional view of the electrolytic cell described in FIG. 2, is shown in FIG. 3. The membrane 13 is between two rubber gaskets (shown in FIGS. 4D, 4E and 5) and all are fastened between the male member 11*b* and female member 12 of the membrane holder. Bolts 25 and nuts 24 are used to secure the membrane 13 in place in the membrane holder. Taps 23*a* and 23*b* are openings in the cell for the removal of the anolyte and catholyte of the electrolytic cell, respectively.

Figure 4A:
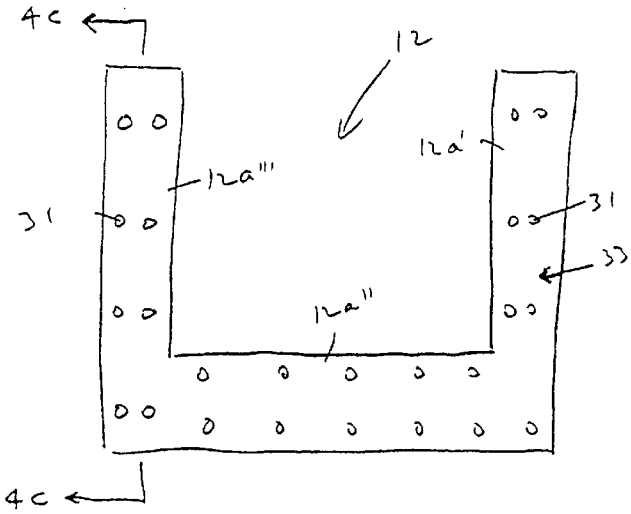
FIG. 4A is a front view of a female member of a membrane holder of the invention.
Figure 4B:
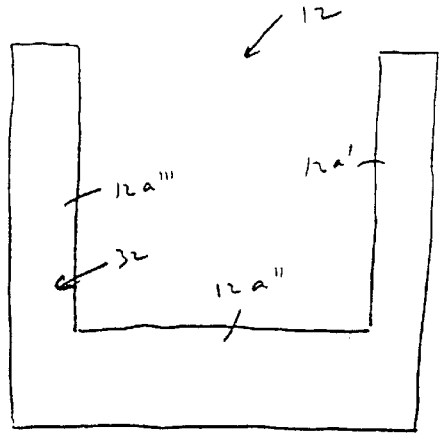
FIG. 4B is a back view of the female member FIG. 4A.

The preferred female member holder 12 shown in FIGS. 4A and 4B has different front and back features. The front shown in FIG. 4A as 33 has threaded circular holes 31 extending partly therethrough in which threaded bolts that hold the membrane(s) in place are fastened. The back side of the female membrane holder shown as 32 has no threaded holes showing that holes 31 extend only partly into female member 12. The use of a combination of membrane gaskets, threaded rods (bolts), and washers to fasten the membrane(s) of choice between the male and female members of the membrane holder ensures the absence of leaks or transmission of material between the catholyte and the anolyte compartments.

Figure 4C:
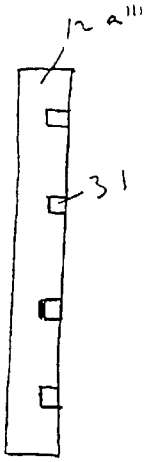
FIG. 4C is a cross-sectional view of the female member of FIG. 4A taken along lines 4C.
Figure 4D:
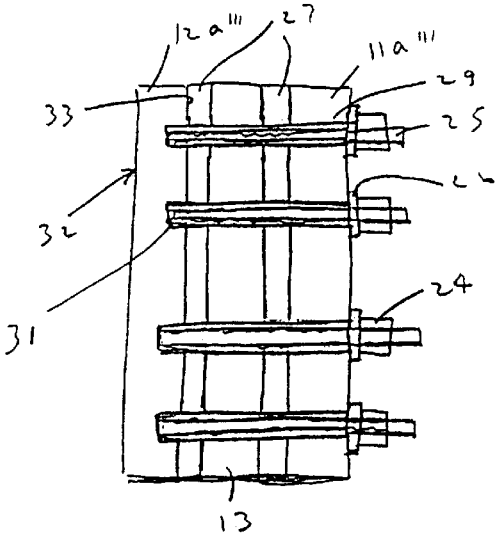
FIG. 4D is a cross-sectional view of an assembled membrane holder of the invention.
Figure 4E:
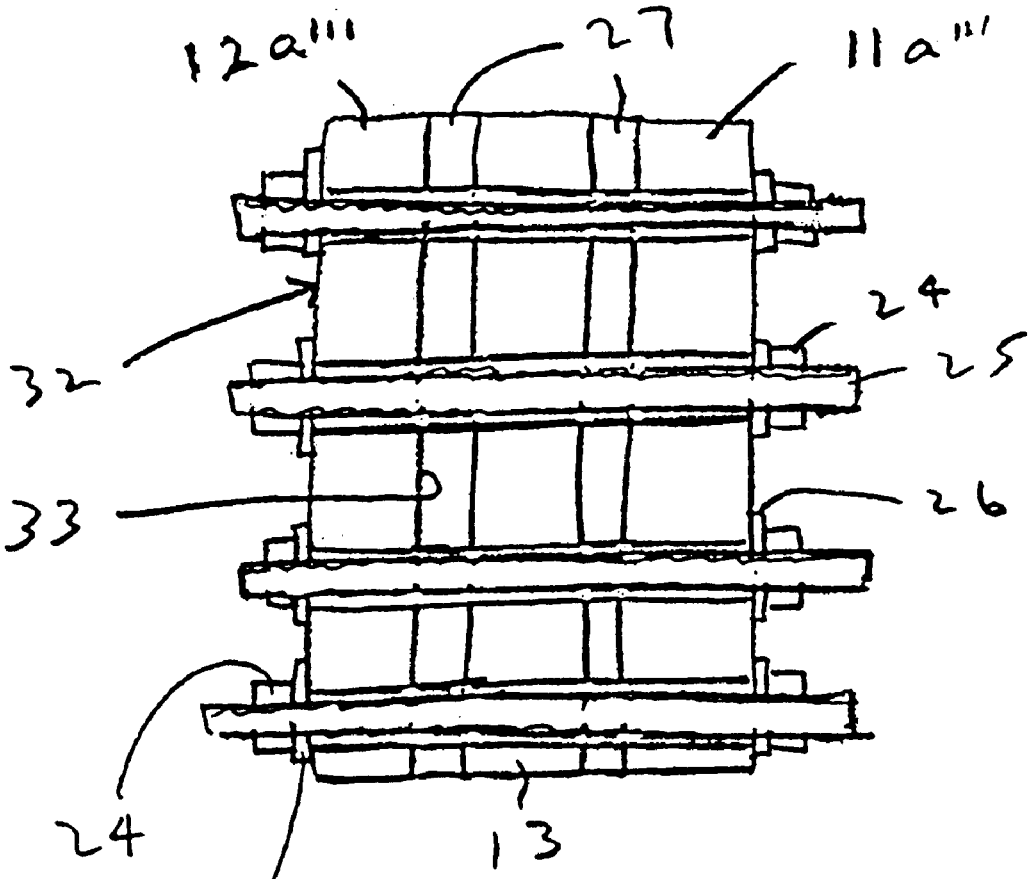
FIG. 4E is a cross-sectional view of another assembled membrane holder of the invention.

It will be appreciated that holes 31 can be through holes and that nuts and washers be used to secure the membrane holder together as shown in FIG. 4E.

As can be seen from FIGS. 4A and 4B, the female member holder is U-shaped and has vertical side leg members 12*a*' and 12*a*''' and a connecting lower member 12*a*''. As discussed hereinabove, such a U-shaped member conforms to the side walls and base of the cell and is secured thereto so that it is integral with the cell providing a watertight seal at the outer peripheral edge of the membrane member.

Referring now to FIG. 4C, a cross-sectional side view of vertical member 12*a*''' shows that the openings 31 extend partly into the female member.

FIG. 4D shows a section of a membrane holder comprising the female vertical member 12*a*''' and the male vertical member 11*a*'''. To assemble the membrane for use in the cell, a bolt 25 would be inserted (threaded) into opening 31 of female vertical member 12*a*''', a gasket 27 sized to fit over the member surface and having openings for the bolts is inserted over the bolt. A membrane 13 having openings for the bolts is similarly inserted over the gasket 27 and bolts 25 followed by another gasket member 27. This assembly is then positioned in the cell and the free end of the bolt inserted through the through opening 29 in the male member 11*a*'''. A washer 26 is then placed over the bolt 25 and the assembly secured by nuts 24 tightened to provide a watertight seal.

Referring to FIG. 4E, an assembled membrane holder is shown as in FIG. 4D except that openings 31 are through openings so that bolts 25 extend through female vertical member 12*a*'''. Washer 26 and nuts 24 would be required as shown to secure the assembly with a water tight seal.

Figure 5:
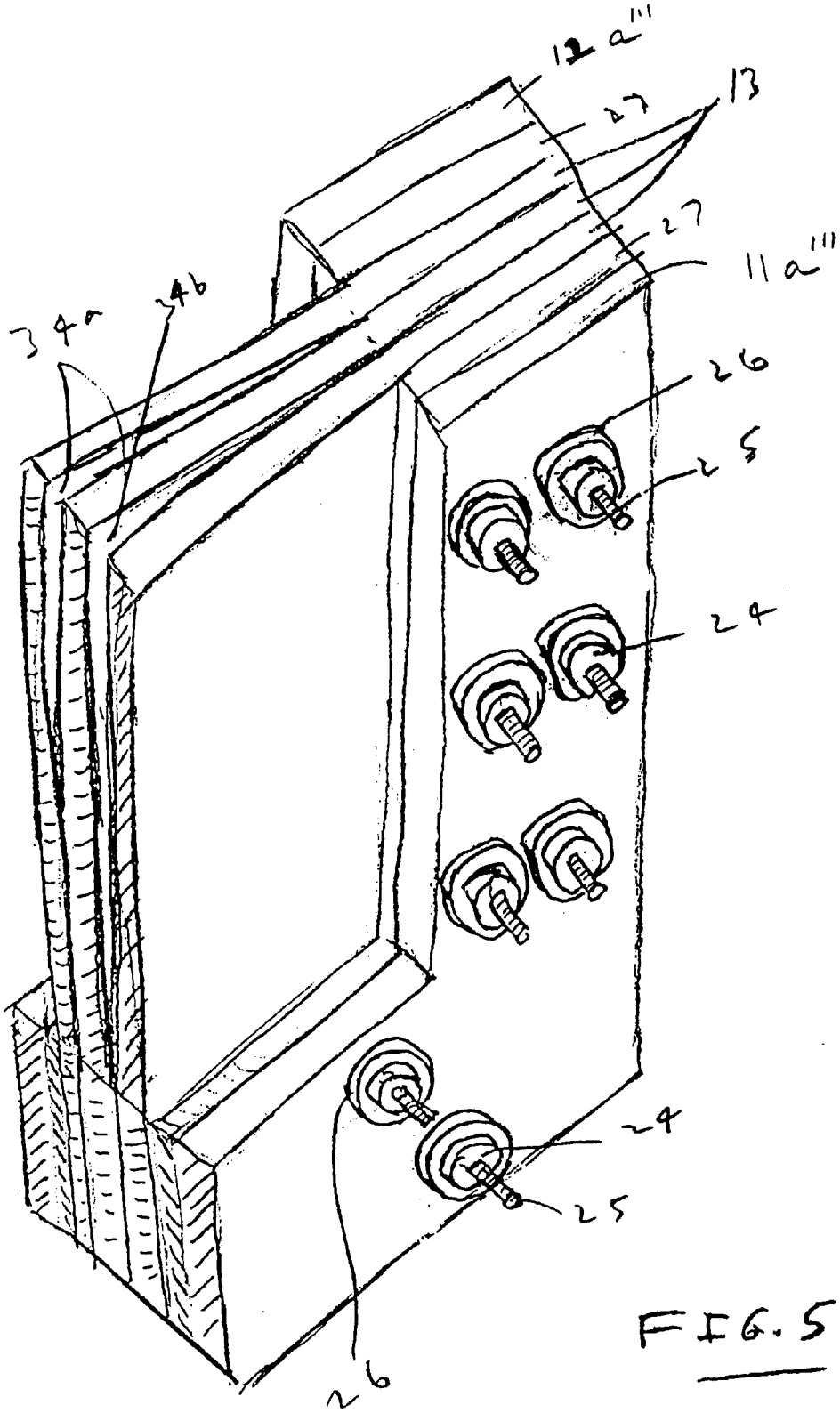
FIG. 5 is a partial perspective view of a membrane holder of the invention holding a membrane.

Referring to FIG. 5, a membrane holder assembly as shown in FIG. 4D is shown partially in perspective. Thus, vertical leg member 12*a*''' of the female membrane holder is shown with a gasket 27 on its inner face followed by three (3) membrane layers 13 and then another gasket 27. The bolt 25 secured to the female member would then be inserted through the through openings in male member 11*a*''' and the assembly secured together using washers 26 and nuts 24. It is noted that using three (3) membrane layers provides two spaces between the membrane layers shown as 34*a* and 34*b*, which spaces are preferably filled with electrolyte. Forming such spaces 34 is possible because the unsecured end (top) of the membrane is free and may be separated and electrolyte filled in the space.

It is preferred that the operation of the specially defined electrolytic cell be operated at a controlled current or voltage, preferably substantially constant. It has been found that during operation both the catholyte and anolyte will have losses, e.g., evaporation, and that enhanced cell performance can be achieved if additional electrolyte is added to the catholyte compartment as needed and that deionized water be added to the anolyte compartment as needed, with both being added to maintain a substantially constant electrolyte level in the cell. A preferred voltage because of its demonstrated effectiveness is about 5 volts and the cell may be effectively operated between about 1 to 30 volts, preferably 2 to 10 volts. A preferred cell current is about 50 to 200 amperes, more preferably 50–130 amperes, e.g., 120 amperes.

Various embodiments of the present invention will now be illustrated by reference to the following specific examples. It is to be understood, however, that such examples are presented for purposes of illustration only, and the present invention is in no way to be deemed as limited thereby.

EXAMPLE 1

This example illustrates the production of a concentrated solution of low alpha lead methane sulfonate using the electrolytic production cell of the invention with an ESC7001 anion exchange membrane. This membrane has a fabric reinforcement backing.

The production cell is rectangular as described above and is made of PVC. The cell comprises an anode compartment (A+B) and cathode compartment separated by an anion exchange membrane termed ESC 7001 and sold by Electrosynthesis Co. Inc., NY. The anode compartment used a platinized-niobium mesh anode cage filled with low alpha lead slugs (0.425"×0.648") and supported by a PVC basket, a heater, and temperature controller, an impeller, fluid level sensor (mounted outside of the anode compartment), and about 85 liters of a 20% methane sulfonic acid (MSA) dissolution medium. The platinized niobium mesh anode cage was filled with about 215 pounds of the low alpha slugs with alpha counts in the range 0.000–0.0002 cts/cm2/hr. In the cathode compartment were two sheets of stainless steel 316 L cathodes (60 cm×50 cm×0.64 cm) and an impeller. The cathode compartment was filled with about 45 liters of 20% MSA electrolyte. The electrolyte level in each compartment was about the same.

The membrane that separated the anode from the cathode consisted of three sheets of the ESC7001 membrane, each with an active surface area of 1600 $cm^2$ and forming two compartments therebetween. The membrane active surface area is defined as the area of the membrane that makes contact with the 20% methane sulfonic acid (MSA) electrolytic medium. The space between the membrane layers were filled with the same 20% MSA acid electrolyte to minimize cell resistance and also acted as an additional safeguard to the anolyte against possible trace metallic contamination from the catholyte. A single membrane layer can also be used instead of layers of the membrane but multiple layers are preferred because they act as a safeguard in cases where there are pinholes in any of the membranes and prevent the undesirable migration of metals from the catholyte to the anolyte or the plate out of dissolved metals from the anolyte on the cathode. Properties of the ESC7001 anion exchange membrane utilized in this example are shown in Table 1.0.

TABLE 1.0

Properties of the ESC7001 Anion Exchange Membrane

| PARAMETER | VALUES |
|---|---|
| Electrical Resistance (Ohm-$cm^2$, A.C.) 1.0N NaCl at 25° C. | 8 |
| % Permselectivity, 0.2N KCl/0.1N KCl | 96 |
| Transport Number 0.5 N KCl/0.1 N KCl | 0.98 |
| Water Permeability ml/hr/$ft^2$/5 psi | <45 |
| Membrane Thickness (mm) | 0.43 |
| Mullen Burst Strength (kg/$cm^2$) | 14.8 |
| Total Capacity meq/g | 1.1 |
| Temperature stability (° C.) | 120 Max. |
| Reinforcement Backing | Fabric |

Prior to electrolysis, the anode compartment was heated to a constant temperature of about 120° F., while the catholyte (through heat transfer from the anolyte) attained a constant temperature of about 98.5° F. A thermostat installed in the anode compartment ensured heating at a constant temperature. Heating of the anolyte automatically shuts off when the fluid level sensor mounted outside of the anode compartment detects a fall in fluid volume below a predetermined level. Impellers used to stir the anode and cathode sections respectively were set at maximum speeds (1700 rpm). Before and during electrolysis, samples of the anolyte and catholyte were taken for lead analysis and monitoring of trace metallic impurity levels. Low alpha lead slugs were dissolved at an average potential of 5.1 volts. Distilled water or 20% MSA were added to the anode or cathode compartments, respectively, at intervals, to compensate for fluid lost to evaporation during electrolysis and to maintain the electrolyte level in each compartment at about the same height.

Table 1.1 shows the electrochemical values obtained when low alpha lead (LAL) slugs were dissolved in the electrolytic production cell incorporated with the ESC7001 anion exchange membrane. A total of 27144.79 grams of LAL slugs dissolved in 92 hours of continuous electrolysis. The power consumption in the production of low alpha lead methane sulfonate was 0.37 kWh per pound. Only 1.2% of the total lead dissolved at the anode plated out at the cathode. The final product in the anode compartment (Table 1.2) consisted of 45 percent of lead methane sulfonate solution, 49.4 percent of free water molecules and 5.6 percent of free methane sulfonic acid electrolyte. The free MSA content of the product can be varied depending on whether distilled water or the MSA electrolyte is added to the anolyte compartment during the lead dissolution process. It is preferred to add deionized water as doing so allows for much of the 20% free MSA started within the anode compartment to be consumed in the final product which is low in free MSA.

Table 1.3 shows the trace metal contents of the anolyte product and waste catholyte after electrolysis. The results show the effectiveness of the designed electrolytic cell of the invention in preventing trace metal contamination of the anode product from the catholyte waste, especially when inexpensive stainless steel materials with possibility for leaching in an acid environment are used as cathodes. The consumption rate of the 20% MSA electrolyte used in the lead dissolution process indicates a desirable linear decrease with time in the concentration of the MSA in the anolyte. The decrease in concentration is faster than the decrease in concentration of MSA in the catholyte.

TABLE 1.1

Production of Lead Methane Sulfonate in PVC Cell Incorporated With ESC7001 Anion Exchange Membrane Electrochemical Values

| PARAMETERS | VALUES ESC7001 Anion Membrane |
|---|---|
| Total Electrolysis Time, (hr.) | 92 |
| Current Consumption, (Amp-hr.) | 8226.7 |
| Constant Temperature of Anolyte (° F.) | 120 |
| Constant Temperature of Catholyte (° F.) | 98.5 |
| Average Output Current (A) | 89.4 |
| Average Membrane Current Density (mA/cm$^2$) | 55.9 |
| Average Cell Potential (Volts) | 5.1 |
| Power Consumption, kWh/lb of $Pb(SO_3CH_3)_2$ | 0.37 |
| Average Lead Dissolution Efficiency (%) | 85.4 |
| Total Lead Dissolved (g) | 27144.79 |
| Average Dissolution rate of Lead Slugs (g/hr.) | 295.1 |
| % dissolved Lead on the Anode Compartment | 98.8 |
| % dissolved Lead on the Cathode Compartment | 1.2 |

TABLE 1.2

Compositions of Anode and Cathode Solutions With ESC7001 Anion Membrane

| | Initial | | | Final | | |
|---|---|---|---|---|---|---|
| Material | Anode | | Cathode | Anode (Product) | | Cathode |
| Solution Volume (liters) | ~85 | | ~45 | 75 | | 43.0 |
| Element or Compound | g/L | % | g/L | g/L | % | g/L |
| Lead dissolved | | | | 357.4 | 23.5 | |
| $Pb(SO_3CH_3)_2$ | | | | 685.4 | 45 | |
| Free MSA | 279 | | 270 | 85.5 | 5.6 | 187 |
| Free $H_2O$ | | | | 752.6 | 49.4 | |

TABLE 1.3

Concentration of Trace Metals From Solutions In PVC Cell Incorporated with ESC7001 Anion Exchange Membrane

| | Metal Concentration (mg/L) | | Metal Concentration (mg/L) | |
|---|---|---|---|---|
| Elements | Anolyte Before Electrolysis | *Anolyte After Electrolysis | Catholyte Before Electrolysis | Catholyte After Electrolysis |
| Ag | <1.0 | <1.0 | 1.0 | 1.0 |
| Sn | <1.0 | <1.0 | 1.0 | 1.0 |
| Nb | <1.0 | <1.0 | 1.0 | <1.0 |
| Ni | <1.0 | <1.0 | 1.0 | 32.3 |
| Cu | <1.0 | <1.0 | 1.0 | 1.0 |
| In | <1.0 | <1.0 | 1.0 | 1.0 |
| Fe | <1.0 | <1.0 | 1.0 | 186.3 |
| Co | <1.0 | <1.0 | 1.0 | 1.0 |
| Zn | <1.0 | <1.0 | 1.0 | 1.0 |
| Cd | <1.0 | <1.0 | 1.0 | 1.0 |
| Cr | <1.0 | <1.0 | 1.0 | 48.0 |

TABLE 1.3-continued

Concentration of Trace Metals From Solutions In PVC Cell Incorporated with ESC7001 Anion Exchange Membrane

| | Metal Concentration (mg/L) | | Metal Concentration (mg/L) | |
|---|---|---|---|---|
| Elements | Anolyte Before Electrolysis | *Anolyte After Electrolysis | Catholyte Before Electrolysis | Catholyte After Electrolysis |
| As | <1.0 | <1.0 | 1.0 | 1.0 |
| Mg | <1.0 | <1.3 | 1.5 | 2.1 |
| Tl | <1.0 | <1.0 | 1.0 | 1.0 |
| Ta | <1.0 | <1.0 | 1.0 | 1.0 |
| U | <1.0 | <1.0 | 1.0 | 1.0 |
| Pt | <1.0 | <1.0 | 1.0 | 1.0 |
| Th | <1.0 | <1.0 | 1.0 | 1.0 |
| Mn | <1.0 | <1.0 | 1.0 | 1.8 |

*Concentration of Pb in the anolyte after electrolysis is 357.4 g/L

EXAMPLE 2

This example illustrates the production of a concentrated solution of low alpha lead methane sulfonate using the electrolytic cell of the invention with a TS-AMX anion exchange membrane. This membrane has a polyvinylchloride fabric reinforcement backing. Table 2.0 shows other properties of the TS-AMX membrane.

The general procedure and apparatus of Example 1 were utilized except for the following: The TX-AMX anion exchange membrane used in the membrane compartment consisted of only two sheets instead of three, with 20% MSA acid in between the membrane sheets. The production cell was operated at an average cell potential of 5.7 volts, Table 2.1. The catholyte through heat transfer from the anode compartment attained a constant temperature of 118° F.

The electrochemical values obtained in the dissolution of low alpha lead (LAL) slugs with the electrolytic production cell incorporated with the TS-AMX anion exchange membrane are shown in Table 2.1. A total of 27,753.4 grams of LAL slugs dissolved in 94 hours of continuous electrolysis. The power consumption in the dissolution process was 0.41 kWh per pound. Only 0.7% of the total lead dissolved at the anode plated out at the cathode. The final product in the anode compartment (Table 2.2) comprised 44.7% of lead methane sulfonate solution, 51.4% of free water molecules and 3.9% of free methane sulfonic acid electrolyte. The free MSA content of the product can be controlled by topping the anolyte fluid level with water during lead dissolution. Table 2.3 shows the trace metal contents of the anolyte product and catholyte waste after electrolysis. The results show the effectiveness of the designed production cell in preventing trace metal contamination of the anode product from the catholyte waste, especially when inexpensive stainless steel materials with the possibility for leaching in an acid environment are used as cathodes. The consumption rate of the 20% MSA electrolyte used in the lead dissolution process indicates a consistent linear decrease in the anolyte MSA concentration with time resulting in a product with low free MSA concentration. This linear decrease is faster than the linear decrease of MSA concentration in the catholyte.

TABLE 2.0

Properties of the TS-AMX Anion Exchange Membrane

| Parameter | Values |
|---|---|
| Electrical Resistance (Ohm-cm$^2$, A.C.) in 1.0N NaCl at 25° C. | 2.5–3.5 |
| % Permselectivity, 0.2N KCl/0.1N KCl | 98 |
| Transport Number 0.5N KCl/0.1N KCl | 0.96 |
| Water Permeability ml/hr/ft$^2$/5 psi | not available |
| Membrane Thickness (mm) | 0.14–0.18 |
| Mullen Burst Strength (kg/cm$^2$) | 4.5–5.5 |
| Total Capacity meq/g | not available |
| Temperature stability (° C.) | 5–50 |
| Reinforcement Backing | Polyvinylchloride fabric |

TABLE 2.1

Production of Lead Methane Sulfonate in PVC Cell Incorporated With TS-AMX Anion Exchange Membrane

| Parameter | Values TS-AMX Anion Membrane |
|---|---|
| Total Electrolysis Time, (hr.) | 94 |
| Current Consumption, (Amp-hr.) | 8356.6 |
| Constant Temperature of Anolyte (° F.) | 120 |
| Constant Temperature of Catholyte (° F.) | 118 |
| Average Output Current (A) | 88.9 |
| Average Membrane Current Density (mA/cm$^2$) | 55.6 |
| Average Cell Potential (Volts) | 5.7 |
| Power Consumption, kWh/lb of $Pb(SO_3CH_3)_2$ | 0.41 |
| Average Lead Dissolution Efficiency (%) | 85.9 |
| Total Lead Dissolved (g) | 27,753.4 |
| Average Dissolution rate of Lead Slugs (g/hr) | 254.5 |
| % dissolved Lead on the Anode Compartment | 99.3 |
| % dissolved Lead on the Cathode Compartment | 0.7 |

TABLE 2.2

Compositions of Anode and Cathode Solutions With TS-AMX Anion Membrane

| | Initial | | | Final | | |
|---|---|---|---|---|---|---|
| Material | Anode | | Cathode | Anode (Product) | | Cathode |
| Solution Volume (liters) | ~85 | | ~45 | 77.1 | | 41.0 |
| Element or Compound | g/L | % | g/L | g/L | % | g/L |
| Lead dissolved | | | | 357.4 | 23.3 | |
| $Pb(SO_3CH_3)_2$ | | | | 685.8 | 44.7 | |
| Free MSA | 272.9 | | 273.4 | 59.6 | 3.9 | 147 |
| Free $H_2O$ | | | | 788.2 | 51.4 | |

TABLE 2.3

Concentration of Trace Metals From Solutions In PVC Cell Incorporated with TS-AMX Anion Exchange Membrane

| | Metal Concentration (mg/L) | | Metal Concentration (mg/L) | |
|---|---|---|---|---|
| Elements | Anolyte Before Electrolysis | *Anolyte After Electrolysis | Catholyte Before Electrolysis | Catholyte After Electrolysis |
| Ag | <1.0 | <1.0 | 1.0 | <1.0 |
| Sn | <1.0 | <1.0 | 1.0 | 260 |
| Nb | <1.0 | <1.0 | 1.0 | <1.0 |
| Ni | <1.0 | <1.0 | 1.0 | 310 |

TABLE 2.3-continued

Concentration of Trace Metals From Solutions In PVC Cell Incorporated with TS-AMX Anion Exchange Membrane

| | Metal Concentration (mg/L) | | Metal Concentration (mg/L) | |
|---|---|---|---|---|
| Elements | Anolyte Before Electrolysis | *Anolyte After Electrolysis | Catholyte Before Electrolysis | Catholyte After Electrolysis |
| Cu | <1.0 | <1.0 | 1.0 | 1.0 |
| In | <1.0 | <1.0 | 1.0 | 1.0 |
| Fe | <1.0 | <1.0 | 1.0 | 168 |
| Co | <1.0 | <1.0 | 1.0 | Not available |
| Zn | <1.0 | <1.0 | 1.0 | 1.43 |
| Cd | <1.0 | <1.0 | 1.0 | <1.0 |
| Cr | <1.0 | <1.0 | 1.0 | 480 |
| As | <1.0 | <1.0 | 1.0 | <1.0 |
| Mg | <1.0 | <1.2 | 1.0 | <1.0 |
| Tl | <1.0 | <1.0 | 1.0 | 1.0 |
| Ta | <1.0 | <1.0 | 1.0 | 1.0 |
| U | <1.0 | <1.0 | 1.0 | 1.0 |
| Pt | <1.0 | <1.0 | 1.0 | 1.0 |
| Th | <1.0 | <1.0 | 1.0 | 1.0 |
| Mn | <1.0 | <1.0 | 1.0 | Not available |

*Concentration of Pb in the anolyte after electrolysis is 357.4 g/L

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method of electrolytically making a metal containing solution comprising the steps of:

providing an electrolytic cell comprising a tank having opposed walls and a bottom, a consumable lead source as an anode, a spaced apart cathode, one or more membrane(s) separating the anode and the cathode forming an anode chamber and a cathode chamber, the membrane(s) having a top edge, bottom edge and opposed side edges and being held along the bottom edge and opposed side edges between a U-shaped membrane holder comprising a female member consisting essentially of opposed vertical members and a connecting lower member, the members having an outer peripheral edge and an inner peripheral edge forming an open space between the inner peripheral edges, and the vertical members and connecting lower member having openings partly therethrough for securing a bolt or other fastener, and a mating male member consisting essentially of corresponding opposed vertical members and a connecting lower member, the members having an outer peripheral edge and an inner peripheral edge forming an open space between the inner peripheral edges, and the vertical members and connecting lower members having through openings therein, corresponding to the openings in the female member, with the female member and male member being secured together by fasteners extending through the openings in the male member and into the female member openings wherein either the outer peripheral edge of the male member or female member forms a watertight seal with the opposed side walls and tank bottom;

supplying a current between the anode and the cathode to electrolytically dissolve the lead anode forming lead ions in the anode chamber and ionizing the methane sulfonic acid in the cathode chamber to form methane sulfonic acid ions;

continuing the current until the desired concentration of lead methane sulfonate solution is obtained; and removing the lead methane sulfonate solution from the tank.

2. The method of claim 1 wherein the membrane is anionic.

3. The method of claim 2 wherein the openings in the female member extend through the member.

4. The method of claim 2 wherein the fastener is a bolt and nut.

5. The method of claim 1 wherein the outer peripheral edges of the male member are integral with the walls and bottom of the tank.

6. The method of claim 1 wherein the metal is lead.

7. An electrolytic cell comprising:

a tank having opposed walls and a bottom;

a consumable lead source as an anode;

a spaced apart cathode;

an energy source for applying an electric current between the anode and the cathode; and one or more membrane(s) separating the anode and the cathode forming an anode chamber and a cathode chamber, the membrane(s) having a top edge, bottom edge and opposed side edges and being held along the bottom edge and opposed side edges between a U-shaped membrane holder comprising a female member consisting essentially of opposed vertical members and a connecting lower member, the members having an outer peripheral edge and an inner peripheral edge forming an open space between the inner peripheral edges, and the vertical members and connecting lower members having openings partly therethrough for securing a bolt or other fasteners therethrough, and a mating male member consisting essentially of corresponding opposed vertical members and a connecting lower member, the members having an outer peripheral edge and an inner peripheral edge forming an open space between the inner peripheral edges, and the vertical members and connecting lower members having through openings therein corresponding to the openings in the female member, with the female member and the male member being secured together by fasteners extending through the openings in the male member and into the female member openings wherein either the outer peripheral edge of the male member or female member forms a watertight seal with the opposed side walls and tank bottom.

8. The electrolytic cell of claim 7 wherein the membrane is anionic.

9. The electrolytic cell of claim 7 wherein the openings in the female member extend through the member.

10. The electrolytic cell of claim 7 wherein the fastener is a bolt and nut.

11. The electrolytic cell of claim 7 wherein the outer peripheral edges of the male member are integral with the walls and bottom of the tank.

12. A U-shaped membrane holder for holding one or more membrane(s) in an electrolytic cell having side walls and a bottom comprising:

a female member consisting essentially of opposed vertical members and a connecting lower member, the members having openings partly therethrough for securing a bolt or other fastener;

a corresponding male member consisting essentially of corresponding opposed vertical members and a connecting lower member, the members sized to mate and form a watertight seal with the female member, with either the female member or male member being sized to form a watertight seal with the side walls and bottom of the cell and having through openings therein in the opposed vertical members and connecting lower member corresponding to the openings in the opposed vertical members and connecting lower member of the female member; and wherein, in use, one or more membrane(s) are secured between the female member and male member and fasteners extending in the openings in the male member and the female member openings secure the membrane (s) in the membrane holder.

13. The membrane holder of claim 12 wherein the openings in the female member are through openings.

* * * * *